US008222554B2

(12) United States Patent
Moon

(10) Patent No.: US 8,222,554 B2
(45) Date of Patent: Jul. 17, 2012

(54) KEY INPUT APPARATUS OF PORTABLE TERMINAL

(75) Inventor: Hee-Cheul Moon, Seoul (KR)

(73) Assignee: Samsung Electronics Co., Ltd. (KR)

( * ) Notice: Subject to any disclaimer, the term of this patent is extended or adjusted under 35 U.S.C. 154(b) by 1008 days.

(21) Appl. No.: 11/870,895

(22) Filed: Oct. 11, 2007

(65) Prior Publication Data

US 2008/0088489 A1 Apr. 17, 2008

(30) Foreign Application Priority Data

Oct. 11, 2006 (KR) ..... 10-2006-0098902

(51) Int. Cl.
*H01H 15/10* (2006.01)

(52) U.S. Cl. ..... 200/547

(58) Field of Classification Search ..... 200/547, 200/18, 5 A, 5 R, 6 A, 248, 249, 5 B
See application file for complete search history.

(56) References Cited

U.S. PATENT DOCUMENTS 5,721,405 A * 2/1998 Hamada ..... 200/18
6,069,327 A * 5/2000 Ushimaru ..... 200/5 R
6,906,269 B2 * 6/2005 Nishimura et al. ..... 200/16 R
7,282,656 B2 * 10/2007 Niiyama ..... 200/5 R

FOREIGN PATENT DOCUMENTS

| | | |
|---|---|---|
| JP | 2002-510940 | 4/2002 |
| JP | 2005-333605 | 12/2005 |
| KR | 1020040110827 | 12/2004 |
| KR | 1020050074747 | 7/2005 |
| KR | 100685258 | 2/2007 |
| KR | 1020070020995 | 2/2007 |
| KR | 100743096 | 7/2007 |
| WO | WO 99/52257 | 10/1999 |

* cited by examiner

*Primary Examiner* — Felix O Figueroa
(74) *Attorney, Agent, or Firm* — The Farrell Law Firm, P.C.

(57) ABSTRACT

A key input apparatus of a portable terminal, which is pushed or slid in various directions so as to make contact with contact pieces is provided. The key input apparatus includes a switch part having a plurality of contact pieces disposed in a circumference of the switch part, the switch part being mounted in a main body of the portable terminal; and a key part being pushed or slid so as to make contact with the contact pieces, the key part corresponding to the switch part.

8 Claims, 5 Drawing Sheets

KEY INPUT APPARATUS OF PORTABLE TERMINAL

PRIORITY

This application claims priority to an application entitled "Key Input Apparatus Of Portable Terminal" filed in the Korean Industrial Property Office on Oct. 11, 2006 and assigned Serial No. 2006-0098902, the contents of which are hereby incorporated by reference.

BACKGROUND OF THE INVENTION

1. Field of the Invention

The present invention relates to a key input apparatus of a portable terminal, and particularly to a key input apparatus of a portable terminal, which can slide to allow each key of the key input apparatus to be pressed for multiple functions.

2. Description of the Related Art

In general, the term "portable communication apparatus" refers to an apparatus that a user can carry to perform wireless communication with a desired partner. Such a portable communication apparatus refers to an HHP (Hand Held Phone), a CT-2 cellular phone, a digital phone, a PCS (Personal Communication Service) phone, and a PDA (Personal Digital Assistant). Such portable communication apparatuses may be classified into various types according to their appearances. For example, wireless terminals are classified into bar-type, flip-type and folder-type terminals according to the external appearance thereof. The bar-type wireless terminal includes a single housing having a bar-shape. The flip-type terminal includes a flip or a cover rotatably coupled to a bar-type housing by means of a hinge device. The folder-type terminal includes a folder rotatably and foldably coupled to single bar-type housing by means of a hinge device. The above-mentioned conventional portable terminals include an antenna device, a data input/output device, and a data transmitting/receiving device. Generally, a key pad allowing a user to input data by pushing the key pad with their fingers is mainly used as a data input device. A touch pad or a touch screen also can be used as a data input/output device.

Furthermore, a function for allowing a user to transmit/receive text messages to/from a desired partner through a key button of a portable terminal has been added to such a conventional wireless terminal.

Basically, a key input device used for inputting data includes a plurality of key arrays. Such a key input device includes a send key as a button for starting a call, a cancel key, a correct key (CLT), a numeric key, a character key, an end key (END), a function key, and a power key, etc.

Furthermore, the key input apparatus includes a keypad mounted on a front surface of the portable terminal and a plurality of side keys which function as a function key and support the function of the keypad.

When the side key of the key input apparatus is made of only rubber material, the side key can make direct contact with a metal dome as a contact means which is mounted in an interior of the main body of the portable terminal. Meanwhile, the side key may include a tact switch made of a combination of plastic injection material and rubber, according to the users' various demands.

As shown in FIGS. 1 to 4, a side key among constitutions of a key input apparatus of a convention portable terminal protrudes from a casing frame 1 of the main body of the portable terminal.

A printed circuit board 2, which is a RF (Radio Frequency) board, is included in the casing frame 1, and a tact switch 4 is included in the printed circuit board 2 so as to correspond to rear surfaces 3*a* and 3*b* of the side key 3 while making contact therewith.

A contact piece 4*a* making contact with a rear surface of the side key 3 protrudes from the tact switch 4.

The side key 3 is included in one side of the casing frame 1, and the tact switch 4 is included in the rear surface of the side key 3. Therefore, when the user pushes the side key 3, the side key 3 moves in a pushing direction, and at the same time, makes contact with the contact piece 4*a* of the tact switch 4.

However, a side key of a conventional portable terminal needs a separate mounting space for allowing a tact switch to be mounted. Furthermore, when a plurality of side keys for various functions are included, the conventional portable terminal needs a plurality of tact switches and mounting space for them. Therefore, the size of the potable terminal becomes larger so that it is difficult to realize the slimness of the portable terminal.

Also, when the number of the side key increases, side keys has to protrude from the portable terminal, so that an appealing appearance thereof can not be secured.

SUMMARY OF THE INVENTION

Accordingly, the present invention has been made to solve the above-mentioned problems occurring in the prior art, and the present invention provides a key input apparatus of a portable terminal, which can slide to allow each key of the key input apparatus to be pressed for multiple functions, so as to reduce the number of keys included in the portable terminal. Therefore, various operation mode functions can be performed.

Also, the present invention provides a key input apparatus of a portable terminal, which can slide to allow a side key of the key input apparatus to be pressed for multiple functions, so as to reduce the number of side keys. As a result, mounting space for keys of the terminal is reduced so that it is possible to realize slimness and size-reduction of the terminal.

Also, the present invention provides a key input apparatus of a portable terminal, which can slide to allow a side key of the key input apparatus to be pressed for multiple functions, thereby reducing the number of side keys. Therefore, manufacturing costs of the portable terminal can be reduced.

In accordance with an aspect of the present invention, there is provided a key input apparatus of a portable terminal including a switch part having a plurality of contact pieces included in a circumference of the switch part, the switch part being mounted in a main body of the portable terminal; and a key part being pushed or slid so as to make contact with the contact pieces, the key part corresponding to the switch part.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF THE EXEMPLARY EMBODIMENT

Figure 1:
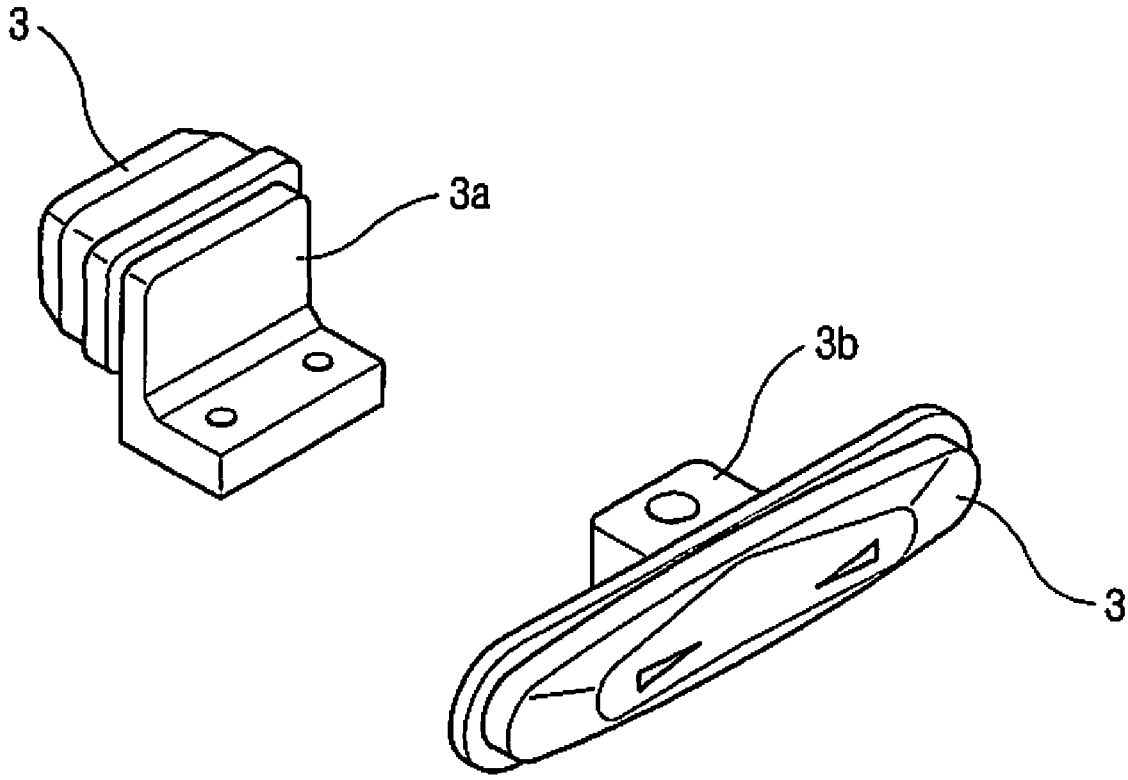
FIG. 1 (PRIOR ART)
FIG. 1 is a perspective view illustrating a side key in a key input apparatus of a conventional portable terminal.
Figure 2:
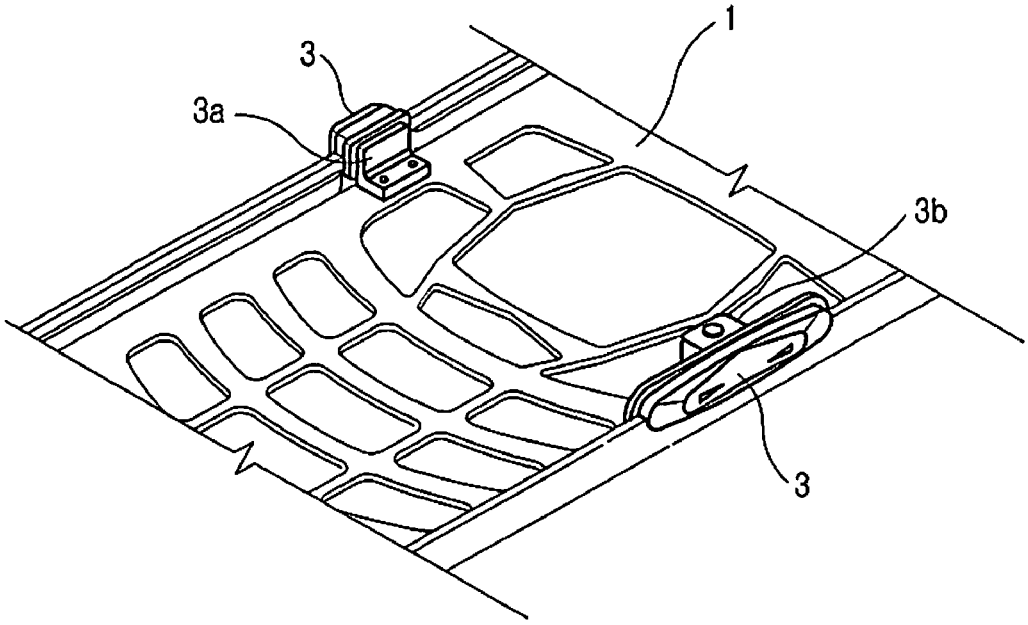
FIG.2 (PRIOR ART)
FIG. 2 is a perspective view illustrating a state of a side key in a key input apparatus of a conventional portable terminal being assembled with the main body of the portable terminal.
Figure 3:
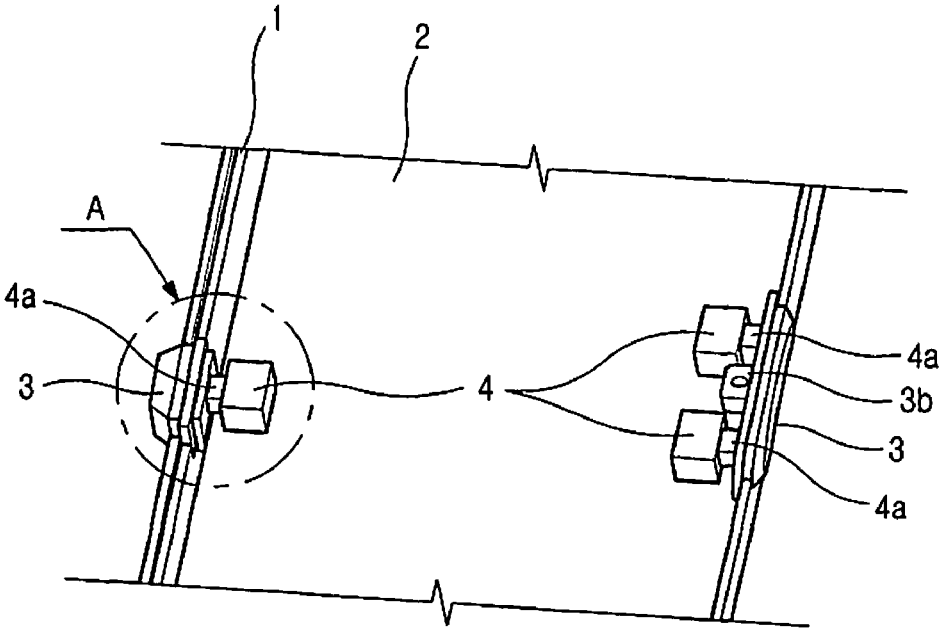
FIG.3 (PRIOR ART)
FIG. 3 is a perspective view illustrating a state of a side key being assembled with a tact switch in a key input apparatus of a conventional portable terminal.
Figure 4:
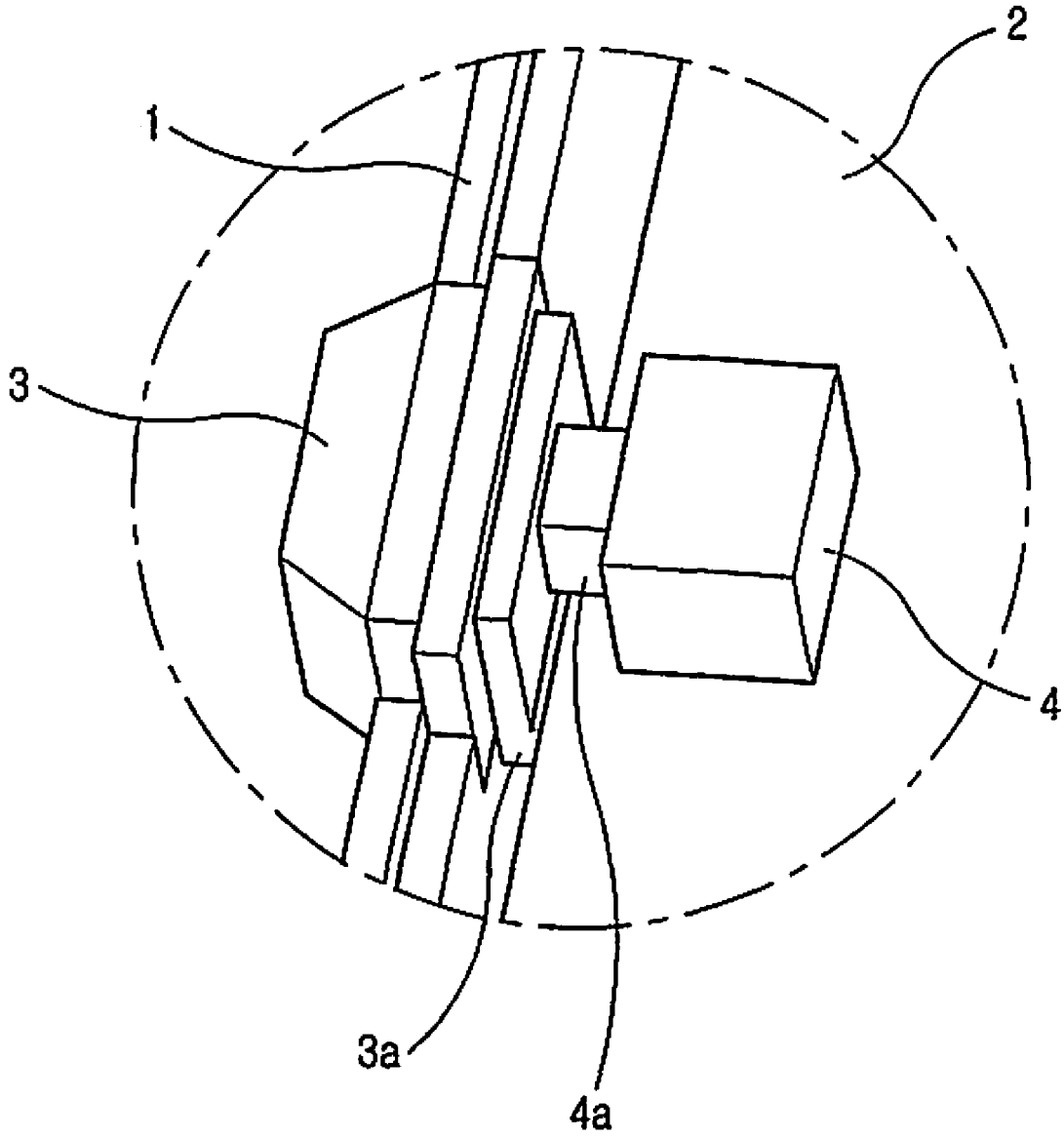
FIG.4 (PRIOR ART)
FIG. 4 is an enlarged perspective view of part A of FIG. 3.

Hereinafter, exemplary embodiments of the present invention will be described with reference to the accompanying drawings. In the following description, the same elements will be designated by the same reference numerals although they are shown in different drawings.

Figure 5:
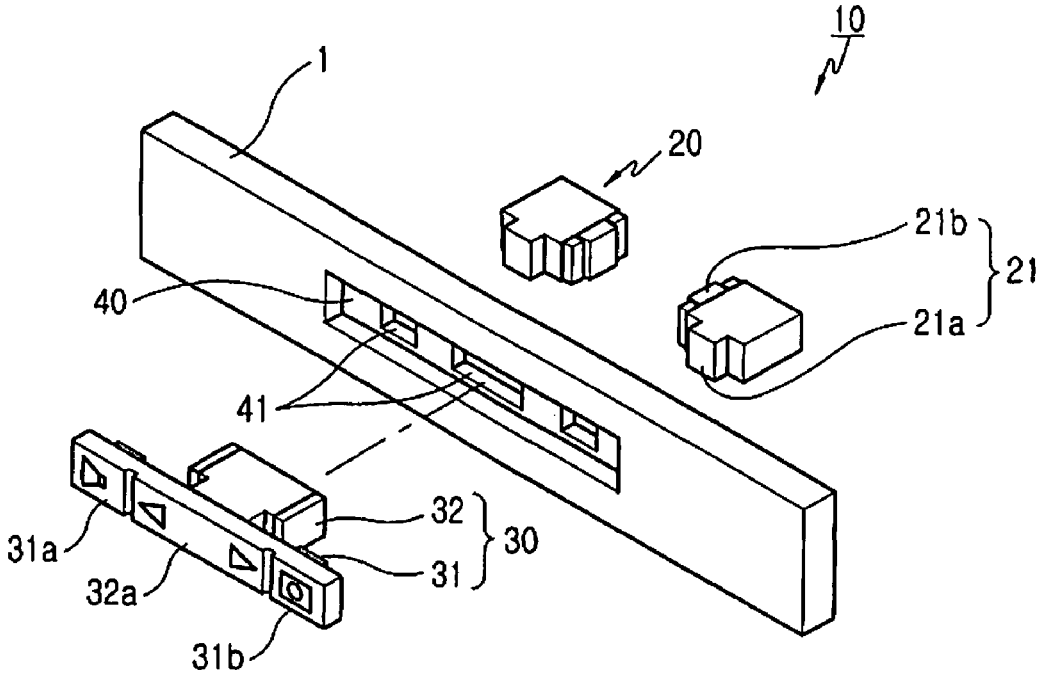
FIG. 5 is a partially exploded perspective view illustrating a structure of a key input apparatus of a portable terminal according to an embodiment of the present invention.

As shown in FIG. 5, a key input apparatus 10 of a portable terminal includes a switch part 20 and a key part 30. The switch part 20 is mounted at a predetermined position of the main body 1 of the portable terminal in such a manner that the switch part 20 makes electric contact with the key part 30 which will be described later. A plurality of contact pieces 21 are included in a circumference of the switch part 20 so as to make contact with the key part 30. The key part 30 corresponds to the switch part 20 so that the key part 30 is pushed or slide so as to make contact with the contact pieces 21.

Figure 6:
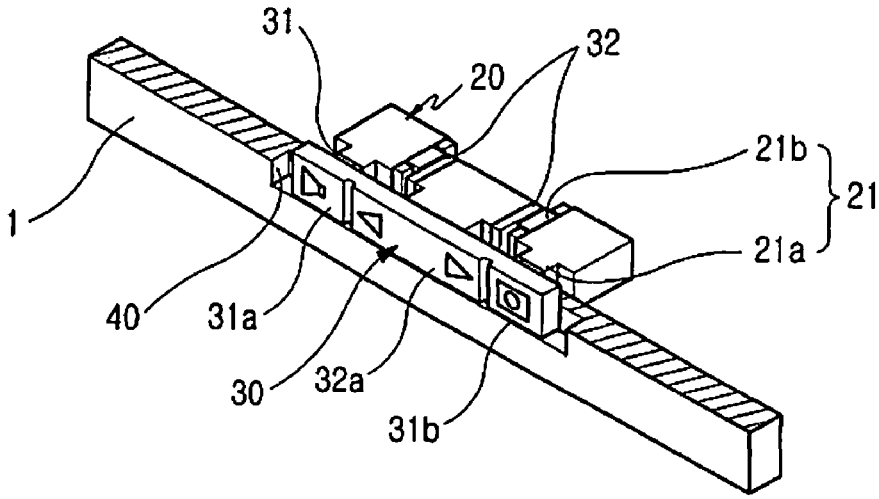
FIG. 6 is a perspective view illustrating a key input apparatus of a portable terminal according to an embodiment of the present invention, in which the key input apparatus is assembled.

As shown in FIG. 6, the key part 30 includes a keypad and a side key for performing various operation mode functions of the main body 1 of the portable terminal.

As shown in FIG. 5, a mounting part 40 is included in the main body 1 of the terminal so as to allowing the key part 30 to be mounted therein. The mounting part 40 has at least one coupling hole 41 through which the key part 30 can extend so as to make contact with the contact pieces 21 of the switch part 20.

Figure 7:
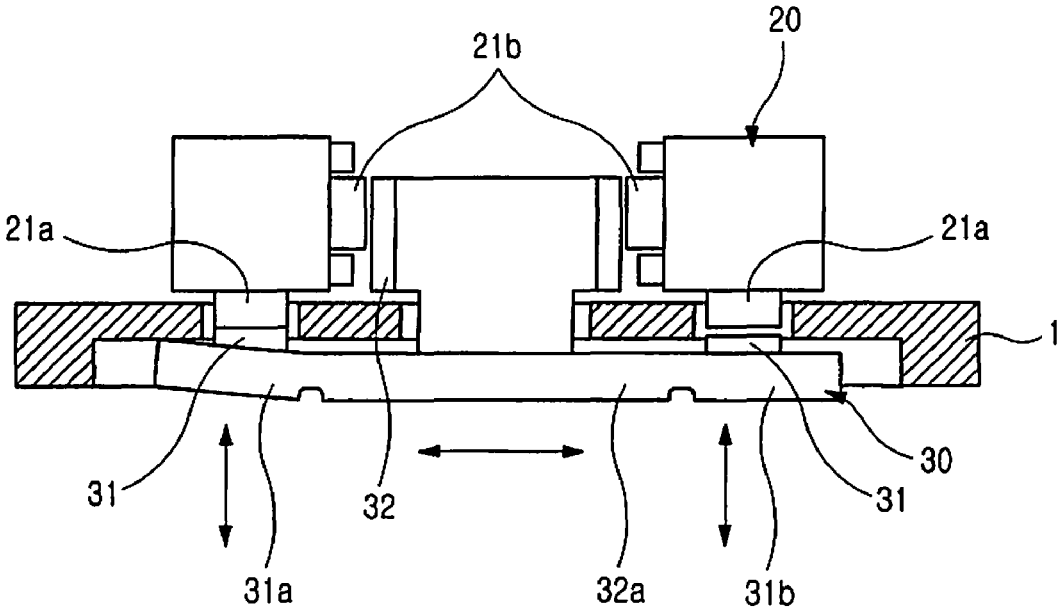
FIG. 7 is a plan view illustrating a push operation of a key input apparatus of a portable terminal according to an embodiment of the present invention.
Figure 8:
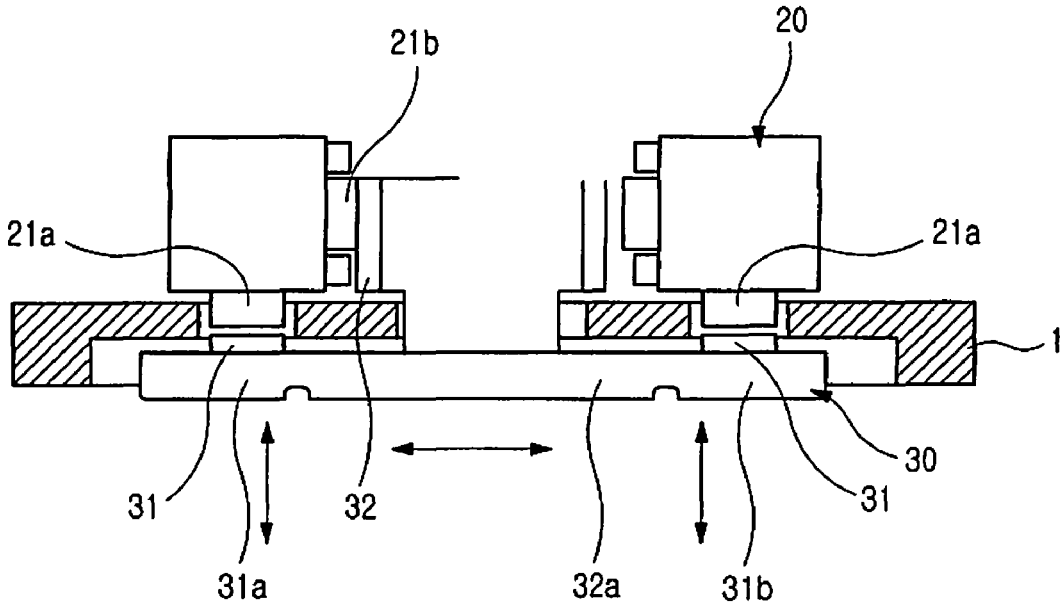
FIG. 8 is a plan view illustrating a sliding movement of a key input apparatus of a portable terminal according to an embodiment of the present invention.

As shown in FIGS. 7 and 8, the contact pieces 21 include the first and second pieces 21*a* and 21*b*, respectively. The first contact piece 21*a* makes electric contact depending on if the key part 30 has been pushed, and the second contact piece 21*b* makes electric contact depending on the sliding movement of the key part 30.

As shown in FIG. 7, the first key contact part 31 is included in both ends of a rear surface of the key part 30 so that the first key contact part 31 can make contact with the first contact piece 21*a* depending on if the key part 30 has been pushed. The second key contact part 32 is included in the central part of the rear surface of the key part 30 so that the second key contact part 32 can make contact with the second contact piece 21*b* depending on the sliding movement of the key part 30. The first key contact part 31 included in one end of the key part 30 has a volume key 31*a* performing a volume raise/lower function, and the first key contact part 31 included in another end of the key part 30 has a camera key 31*b* operating a camera module.

As shown in FIG. 8, the second key contact part 32 has a control key 32*a* which is used to control the volume of the main body 1 of the terminal, and is used to control a camera function of a camera.

With reference to FIGS. 5 to 8, the operation of the key input apparatus, which has such a structure, of the portable terminal according to an exemplary embodiment of the present invention will be described below in more detail.

As shown in FIG. 5, the key input apparatus 10 of a portable terminal includes a switch part 20 having a plurality of contact pieces 21 and a key part 30. The contact pieces 21 are included in a circumference of the switch part 20. The key part 30 is mounted in the mounting part 40 formed on a side surface of the main body 1 of the terminal, and the first and second key contact parts 31 and 32 of the key part 30 are assembled with the coupling hole 41 formed in the mounting part 40 while extending through the coupling hole 41.

As shown in FIG. 6, the first and second key contact parts 31 and 32 correspond to the first and second contact pieces 21*a* and 21*b* of the switch part 20, respectively. The key part 30 has a side key of the main body 1 of the terminal, and the switch part 20 includes a tact switch.

As shown in FIG. 7, the volume key 31*a* is included in one end of the key part 30, the camera key 31*b* is included in another end of the key part 30, and the control key 32*a* is included in the main part of the key part 30.

In this state, as shown in FIG. 7, when the volume key 31*a* of the key part 30 is pushed so as to perform various operation mode functions of the terminal 1, the first key contact part 31 included in one end of the key part is pushed toward the interior of the main body 1 of the terminal, and the first key contact part 31 makes electric contact with the first contact piece 21*a* of the switch part 20 and also applies a signal of the first contact piece 21*a* to a control unit (not shown) included in the main body 1 of the terminal.

When the camera key 31*b* is pushed, the first key contact part 31 included in another end of the key part is pushed toward the interior of the main body 1 of the terminal, and the first key contact part 31 makes electric contact with the first contact piece 21*a* of the switch part 20 and also applies a signal of the first contact piece 21*a* to a control unit (not shown) included in the main body 1 of the terminal.

As shown in FIG. 8, when the control key 32*a*, which is formed in the central part of the key part 30 so as to control the volume and the function of the camera, slides in a left or right direction, the second contact part 32 included in the central part of the rear surface of the key part 30 moves in the sliding direction of the control key 32*a*. The second key contact 32 makes electric contact with the second contact piece 21*b* of the switch part 20 and also applies a signal of the second contact piece 21*b* to the control unit (not shown) included in the main body 1 of the terminal.

As mentioned above, the side key of the main body of the terminal is adapted to be pressed or slid in various directions so that the number of the side keys can be reduced. Therefore, the manufacturing cost of the terminal and mounting space for keys can be reduced, thereby realizing slimness and size-reduction of the terminal. The present invention can be employed in all type terminals which can be carried.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A key input apparatus of a portable terminal, comprising a key part corresponding to a switch part having a plurality of contact pieces, the key part being pushed or slid so as to make contact with the contact pieces, wherein the contact pieces comprise at least two linearly arranged first contact pieces facing a first direction and at least two second contact pieces facing each other, one of the at least two first contact pieces making electric contact when the key part is pushed opposite to the first direction such that the key part engages one of the at least two first contact pieces along the first direction, and one of the at least two second contact pieces making electric contact when the key part is slid in a second direction that is perpendicular to the first direction such that the key part engages one of the at least two second contact pieces along the second direction, wherein at least two first key contact parts are disposed respectively in both ends of a rear surface of the key part, one of the at least two first key contact parts making contact correspondingly with one of the at least two first key contact pieces when the key part is pushed at respective one of the both ends.

2. A key input apparatus of a portable terminal, comprising:

a switch part having a plurality of contact pieces disposed in a circumference of the switch part, the switch part being mounted in a main body of the portable terminal; and a key part being pushed or slid so as to make contact with the contact pieces, the key part corresponding to the switch part, wherein the contact pieces comprise at least two linearly arranged first contact pieces facing a first direction and at least two second contact pieces facing each other, one of the at least two first contact pieces making electric contact when the key part is pushed opposite to the first direction such that the key part engages one of the at least two first contact pieces along the first direction, and one of the at least two second contact pieces making electric contact when the key part is slid in a second direction that is perpendicular to the first direction such that the key part engages one of the at least two second contact pieces along the second direction, and wherein at least two first key contact parts are disposed respectively in both ends of a rear surface of the key part, one of the at least two first key contact parts making contact correspondingly with one of the at least two first key contact pieces when the key part is pushed at respective one of the both ends.

3. The key input apparatus as claimed in claim 2, wherein the key part includes a keypad and a side key, the key part performing various operation mode functions of the portable terminal.

4. The key input apparatus as claimed in claim 2, wherein the main body of the portable terminal has a mounting part for mounting the key part.

5. The key input apparatus as claimed in claim 4, wherein at least one coupling hole is formed in the mounting part, the key part extending through the at least one coupling hole so as to make contact with the contact pieces.

6. The key input apparatus as claimed in claim 2, wherein at least two second key contact parts are disposed in a central part of the rear surface of the key part, one of the at least two second key contact parts making contact correspondingly with one of the at least two second contact pieces when the key part is slid in a direction corresponding to the one of the at least two second key contact parts.

7. The key input apparatus as claimed in claim 6, wherein the at least two first key contact parts include a volume key disposed at one end of the key part and a camera key disposed at an other end of the key part, the volume key performing an audio volume raise/lower function, and the camera key operating a camera module.

8. The key input apparatus as claimed in claim 6, wherein the at least two second key contact parts include a control key for controlling audio volume of the portable terminal.

* * * * *